United States Patent [19]

Eigenmann

[11] 4,069,281

[45] Jan. 17, 1978

[54] PREFABRICATED ROADWAY MARKING STRIP MATERIAL AND METHOD FOR PRODUCING SAME

[76] Inventor: Ludwig Eigenmann, Vacallo, Ticino, Switzerland

[21] Appl. No.: 617,447

[22] Filed: Sept. 29, 1975

[30] Foreign Application Priority Data

Sept. 30, 1974 Italy ..... 27881/74

[51] Int. Cl.[2] ..... B29D 11/00

[52] U.S. Cl. ..... 264/1; 264/35; 264/167; 264/171; 264/255; 350/105; 404/14; 404/16

[58] Field of Search ..... 264/1, 35, 167, 171, 264/212, 214, 255; 404/14, 16; 350/105, 109; 427/137

[56] References Cited

U.S. PATENT DOCUMENTS

| | | | |
|---|---|---|---|
| 3,002,615 | 10/1961 | Lemelson | 264/167 X |
| 3,587,415 | 6/1971 | Eigenmann | 350/105 X |
| 3,785,719 | 1/1974 | Jonnes | 350/105 |
| 3,936,533 | 2/1976 | de Jong | 427/137 |

*Primary Examiner*—Thomas P. Pavelko
*Attorney, Agent, or Firm*—Michael J. Striker

[57] ABSTRACT

A method of producing a prefabricated roadway marking strip material adapted to be applied on and secured to selected areas of a prepared roadway pavement so as to form thereon a traffic regulating indicium comprised of defined signalling surfaces having nighttime visibility and non-skid properties consistent with that of the adjacent roadway pavement. The material comprises a base layer and a traffic-regulating, sign-forming and traffic wear-resisting upper layer having a generally smooth surface, spaced protuberances bulging from said surface and reflective elements concentrated on the top portions of the protuberances for providing said visibility and non-skid properties.

2 Claims, 11 Drawing Figures

PREFABRICATED ROADWAY MARKING STRIP MATERIAL AND METHOD FOR PRODUCING SAME

BACKGROUND OF THE INVENTION a. The Field of the Invention

This invention is concerned with the art of producing and making use of prefabricated strip material adapted to be laid on and adhesively secured to the pavement of highways and other roadable areas to form on said areas traffic regulating signs and markings, such as traffic lane dividing lines, parking areas defining lines, pedestrian crossing signalling strips and the like.

b. The Prior Art

This art is a well known and worked one and extensive comments thereabout are unnecessary. The strip material is primarily designed to form at selected areas on the roadway pavement neatly visible markings of such color (generally white or light) in sharp contrast with that (generally dark) of the adjacent surface of the pavement, the visibility of the markings requiring that the upper face of the marking strip will not be dirt-retentive. Further a good nighttime visibility at distance, when the marking is illuminated by the vehicle headlamps only, is greatly desirable, and therefore the provision of suitably retro-collimating elements on its said upper face is wanted. Still further, the marked area, that is the upper face of the strip face of the strip material laid on and secured to the roadway pavement, forms a portion of the roadable area and, therefore, said material must resist to most severe abuse and provide a desirably long service-life, and also be firmly secured to its substratum, that is the roadway pavement or, preferably, a generally bitumen-based "primer" layer preliminary laid and doctored on said pavement to provide a water impervious and smooth surface best suitable for laying and adhering the strip material thereon.

A number of patents and patent publications related to the art to which this invention appertains have heretofore been made open to public inspection. The most of the problems involved in this art have been extensively discussed in the U.S. Pat. Nos. 3,399,607 and and 3,782,843 of the United States of America, to the present Applicant. An advantageous manner for retro-reflecting "grazing" light (that is the light emitted by vehicle headlamps and which impinges on the marked area in a direction forming a very small angle with the marked surface) has been described in the other U.S. Pat. No. 3,587,415 to the present Applicant. A more intense optical response to grazing light can be provided by partially embedding in the road marking strip material retro-collimating elements comprising each a transparent spheroidal body having a monolayer of reflectorized tiny beads or of reflectorized concave part-spherical surface partially arranged thereabout, as detailedly explained and illustrated in the British Patent Specification No. 1,343,196, also of the present Applicant.

An important and recent improvement to the art of forming marking strip materials possessing an extremely advantageous resistance to traffic wear, together with non-skid properties, consists of forming at least the upper layer of the strip of polyurethane resin or other synthetic resin having a highest molecular internal cohesion, and of embedding in said upper layer very hard crystals, such of corundum. This latter improvement has been disclosed in the published specifications of the French patent application No. 73-18464 (and German patent application No. 2,326,925).

It has been however experienced that, while it can be said that a number of the problems involved in the provision of a really efficient, durable and satisfyingly economical marking strip material have been individually solved by prior art, a long felt want still exists for a strip material which jointly possesses any of the apparently conflicting desired properties.

SUMMARY OF THE INVENTION

It is therefore a principal object of this invention to provide a new and advantageous marking strip material comprising a lower face adapted to be contacted with and adhesively secured to a bitumen-based substratum (such as the surface of a roadway pavement or, more preferably, of a primer layer preliminarily and freshly formed on said pavement) and an upper face which is smooth and not dirt-retentive in the most of its area for best visibility and signalling service, and which is also non-skiddish for vehicular traffic safety, said upper face being provided by a strip upper layer of such composition, arrangement, combination and relative position of compounds and of elements that said most desirable combination of properties is maintained for efficiency of the marking essentially until said upper layer is completely worn off, for extended service life of the marked area and traffic regulating sign under the most severe traffic abuse and weather.

More specifically, it is an object of the invention to provide a roadway surface marking strip material which comprises a flexible base layer having a lower face adapted to contact and adhesively adhere to a bitumen-based roadway pavement, preferably to a primer layer freshly preformed on said pavement, and formed of a composition including resins and elastomers, and an upper traffic wear resisting layer consisting essentially of a high cohesion resin, preferably selected in the group comprising polyurethane resin, polyamide resin and polyester resin, compatible with the composition of said base layer, said base and upper layer being intimately and permanently bonded at the interface formed therebetween, the said upper layer comprising a upper traffic contactable upper face which forms the marked area and have a number of protuberances spaced lengthwise of the strip material and a plurality of retro-reflective elements secured to end seated on said traffic contactable upper face, concentrated in said protuberances and jointly covering a minor portion of the latter upper face for providing both nighttime visibility and non-skid properties to the said marked area.

These and other features and advantages of the invention, together with method steps for producing the strip material of the invention, will be made best apparent from the following detailed description of preferred embodiments of same invention, reference being made to the accompanying drawings.

THE SEVERAL VIEWS OF THE DRAWINGS

DETAILED DESCRIPTION OF THE REFERRED EMBODIMENTS

Referring first to the features which are common to any embodiment of the invention, and wherein the criticalities of same invention can be found, the improved roadway marking strip material is assumed to have been applied on and secured to a primer layer generally indicated at P and preformed upon the surface S of a highway pavement, for example, to form thereon a defined signalling surface area S*s* (a traffic lane dividing line, for example). Such primer layer P is generally but not exclusively formed with a composition including bitumen and resins and such resins are preferably of cross-linkable type and the cross-linking is preferably but not exclusively promoted by chemical agents which might form complemental part of the composition of the marking strip.

The marking line forming strip material, generally indicated at M, comprises at least two superimposed and permanently connected layers including a base layer 10 and a traffic regulating and resisting upper layer 12 (FIGS. 1, 4, 5 and 6 to 11), the said upper layer 12 and preferably the said base layer also being pigmented or otherwise compounded so that to provide the marked or signalling surface area S*s* with a color sharply distinct from that of the surface S of the adjacent uncovered roadway pavement.

Figure 1:
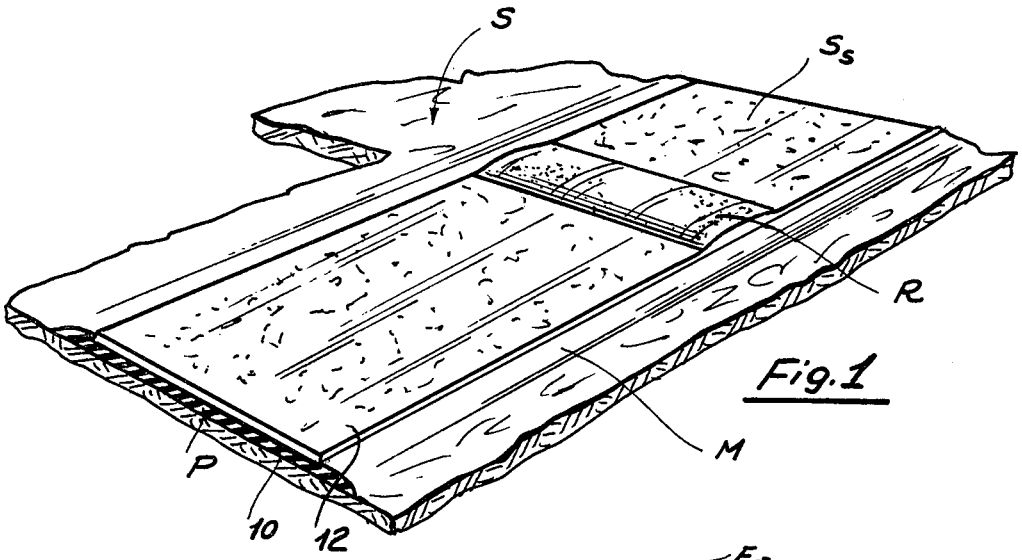
FIG. 1 is a diagrammatical fragmentary perspective view of a first embodiment of the new strip material, in service.
Figure 2:
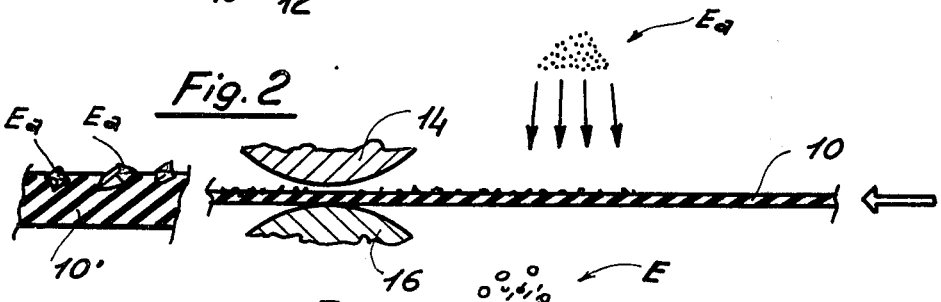
FIGS. 2, 3, 4 and 5 illustrate, respectively, successive steps of the method for producing the material of FIG. 1, which is shown in diagrammatical vertical longitudinal sectional view, and wherein the lefthand part of each FIGURE fragmentarily illustrates the same material resulting from the respective step, in greatly enlarged scale.
Figure 6:
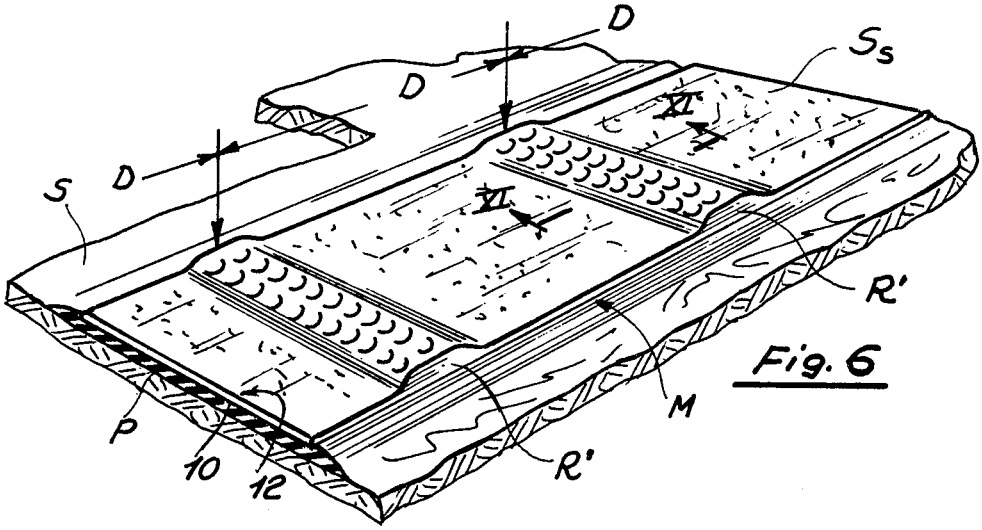
FIG. 6 is a view similar to that of FIG. 1 and illustrates another embodiment of the strip material.
Figure 7:
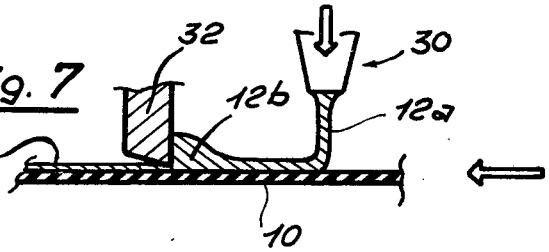
FIGS. 7, 8 and 9 illustrate steps for forming the material of FIG. 6, in a manner similar to that of the right-hand portions of FIGS. 2 to 5.
Figure 8:
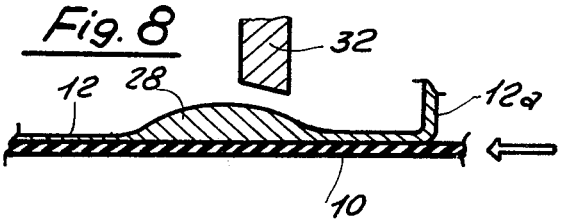
Figure 9:
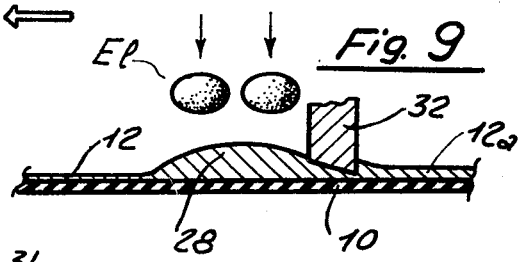

According to an essential feature of the invention, the upper layer 12 is provided with integrally formed or intimately connected protuberances such as generally indicated at R in FIG. 1 and R′ in FIG. 6, and with elements, generally indicated at E which at least in part comprise optically responsive elements E*o*, capable of retroflecting the light emitted by vehicles' headlamps, and preferably also abrasive elements E*a*, such as crystalline particles of preferably inorganic substance of hardness over 5 and preferably over 7 of the Mohs's Hardness Scale (the provision of such particles appertains to prior art and no further comment is necessary) for improving the anti-skid properties of the signalling area S*s*, taking however into consideration that the provision of tiny optical elements E*o*, such as reflectorized glass beads, also well known in the art, has been surprisingly found as capable to give a substantial contribute for improving the said desired non-skid properties, provided that such elements form by themselves particles upwardly jutting from upwardly convex surfaces such as those of said protuberances R or R′.

A fair compromise between the attainment of a suitable anti-skid property (the best value is that of the adjacent not marked area S of the roadway pavement, for ensuring the uniformity of the behaviour of the vehicles on the entire roadable area) and the general smoothness of the marked area (for making the same not or not noticeably dirt retentive), comprises providing on the signalling area or marking surface S*s* a number and a population of elements E such to cover from 10 to 30 percent of said area (the selection of such areal coverage depending from the average weather and climate of the country or location), provided that the most of said elements E is concentrated or mostly and even totally arranged on the said protuberances. Preferred embodiments and arrangements of said elements E will be described below.

The base layer 10 is preferably of thickness comprised from 0.5 *a,d* 1.5 millimeters and consists of an essentially flexible but not extensive strip material capable of resisting to the forces and stresses that a travelling vehicle can apply. Its resistance to tension and to elongation can be improved by reinforcing said layer with glass and preferably synthetic fibers, such as lengthwise arranged roving, or preferably with a polyester or polyamide fabric.

Said base layer is preferably formed of a calendered strip of a composition comprising an elastomeric substance, resins, pigments and fillers adapted to impart roughness to the strip faces. Preferably such base layer comprises nitrilic and/or chlorobutadiene rubbers, low molecular weight polyethylene or styrene resins, plasticizers, coumarone resins, and quartz and/or silica. A preferred base layer composition consists of, in parts by weight:

| EXAMPLE | | | | | |
|---|---|---|---|---|---|
| Regenerated nitril rubber | from | 12 | to | 13 | percent |
| Chlorobutadiene rubber (neoprene) | from | 5 | to | 6.5 | percent |
| Low molecular weight polythylene or styrene resin | from | 6.5 | to | 7.5 | percent |
| Plasticizer hard at room temperature (such as "Escorex 1102" | from | 0.0 | to | 5 | percent |
| Coumarone resin (such as "Cumar P25") | from | 2.5 | to | 7.7 | percent |
| Quartz (6000 mesh) | | | | 50 percent about | |
| Colloidal silica or hard kaolin | from | 5 | to | 13.5 | percent |
| Pigments | | from 12 to 13 percent about | | | |

The upper layer 12 is made by spreading and doctoring a high cohesion resin on said lower layer, such resin being preferably comprised in the group consisting of polyurethane, polyester and polyamide resins, polyurethanes being the most preferred. The said protuberances R or R′ are formed by feeding additive amounts of the resin at the desired locations or by causing the doctored resinous layer to somewhat pile-up or stack at said locations. The elements E are caused to drop on and, if required, are pressed into the layer of freshly applied resin, when the same is still nearly liquid and capable of wetting said elements.

The essential steps for producing a marking strip material essentially as shown in FIG. 1 will be now briefly described with reference to FIGS. 2 to 5.

Over a calendered base strip 10, as above described, a low density amount of abrasive particles E*a* is caused to drop to provide a largely spaced population of said particles over the base strip or layer. Said particles consist of tiny corundum or quartz crystals. The thus scarcely covered base strip is calendered such as between rollers 14 and 16 so that such abrasive particles E*a* are nearly totally encased in the base strip, now referred and identified by 10′ in FIG. 2 and as illustrated in the lefthand portion of same FIG. 2.

Figure 3:
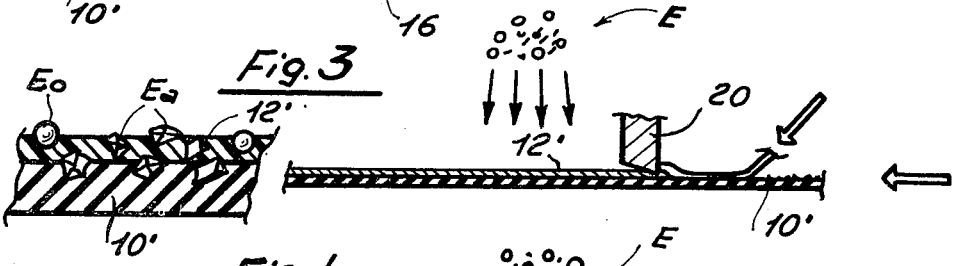
Figure 4:
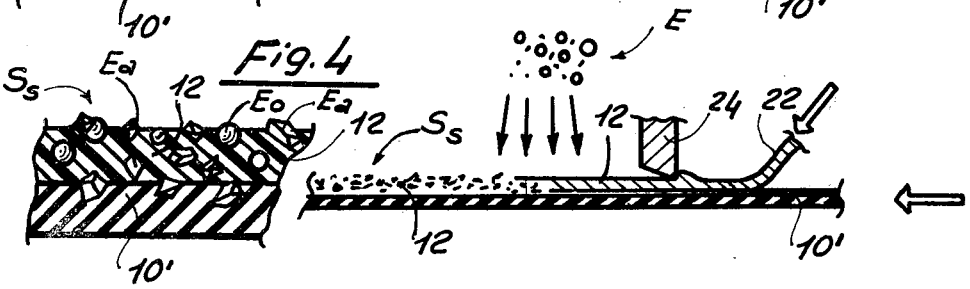
Figure 5:
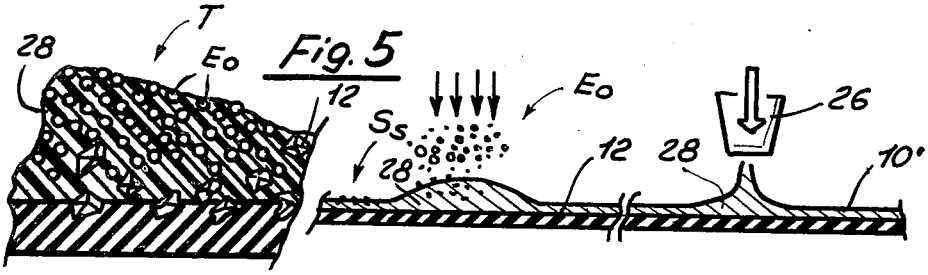

As shown in FIG. 3, the such formed abrasived layer 10′ is then coated with a thin layer (such as 0.5 mm thick) of upper layer forming resin, doctored at 20 and then coated again with well spaced elements E, which comprise either abrasive elements E*a* and optical elements E*o*, such as reflectorized glass beads (as well known). The same step is repeated as shown in FIG. 4, by applying a further resinous layer at 22, doctored at 24, to provide the upper layer 12 of the desired thickness, these steps of FIGS. 3 and 4 being repeated more than two times if a material provided with a thicker upper layer 12 having elements E enclosed thereinto is desired.

Finally, extra amounts of resin are poured at 26 (FIG. 5) at spaced locations lengthwise of the strip material, to form protrusions or protuberances 28 (after then the resin as set as a convex bulge) on which, prior than the resin has set, a more dense shower of particles is caused to locally drop on said protuberances 28. The means provided for performing said addition localized at 26 comprises elongated outlet means, arranged transversally of the strip and activated at time intervals while the material is progressed in the direction indicated by arrows in FIGS. 2 to 4, whereby a marking strip material as shown in FIG. 1 is provided.

From what above it is therefore evident that the invention provides a new and advantageous road surface marking strip material. Such material comprises a flexible base layer best adapted for intimate firm connection both with the tape receiving substrate, at its lower interface, and with an upper layer, at its upper interface, and an upper layer. Such upper layer is of such composition that it resists to and can very slowly progressively be worn off by the traffic. Such upper layer comprise further spaced protuberances bearing closedly spaced elements comprising retro-reflective elements to provide both good non-skid properties and good nighttime visibility, while the remaining major portion of the signalling area (S*s*) in smooth and not dirt-retentive, said protuberances being integral with the composition of said upper layer. As shown in FIGS. 2 to 5, the said upper layer (generally indicate at 12) comprises preferably abrasive and possibly reflective element in its entire thickness, so that the marking strip maintain its desired anti-skid property irrespectively of its degreee of wear; while the concentration of elements at said protrusions or protuberances leads to a negligible wear of such protuberances.

FIGS. 6 to 11 disclose a modified embodiment of the invention, particularly adapted where superior nighttime visibility is wanted. In such embodiment the upper layer 12 comprises spaced transversal protuberances R′ spaced lengthwise of the strip at distances D comprised preferably from 50 cm 150 cm, having at their tops at least one and preferably two ranks of retrocollimating essentially lens-shaped elements E*l* of the type (see in particular FIG. 11) comprising a flattened transparent spheroid of essentially elliptical configuration in its cross-sections including the minor axis of the ellipse, and having an inwardly reflective coating or, preferably, a monolayer of inwardly reflectorized beads thereabout, for more intense retro-collimation (said coating or said monolayer being removed, say by brushing or by the same traffic, where the elements E*l* are uncovered by the upper layer material).

Figure 11:
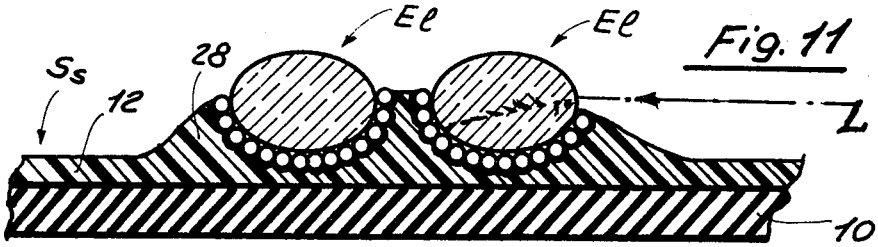
FIG. 11 is a fragmentary sectional view, in greatly enlarged scale, taken in the plane indicated at XI—XI in FIG. 6.

Said modified embodiment can be produced by pouring at 30 (FIG. 7) on the lower or base layer 10 the polymeric substance 12*a* (preferably polyurethane) designed to form the upper layer, which is doctored at 32, over the base layer progressed in the direction indicated by the arrow. By disactivating time to time the doctoring means 32 (FIG. 8) the stacked amount 12*b* (FIG. 7) of the poured substance will flatten and form a protuberance 28 (FIG. 9) on which the retro-collimating elements E*l* are immediately caused to drop and partially compenetrate in such protuberance, as shown in FIG. 11.

Figure 10:
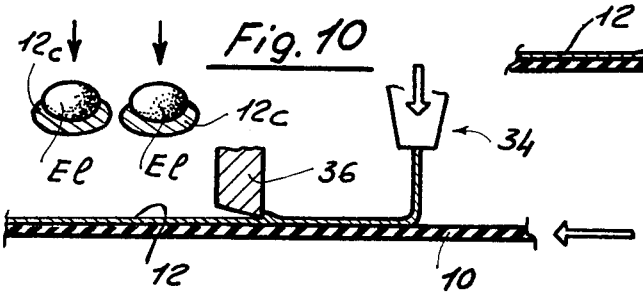
FIG. 10 illustrates a modification of the step of FIG. 9.

The exceptionally wetting and binding power of said polymeric substances, preferably polyurethanes, when semifluid and respectively when completely set, makes feasible the advantageous step illustrated in FIG. 10: this procedure comprises preliminarily wetting the elements E*l* to form thereon and therebelow a layer 12*c* of the semifluid polymer and then let such elements fall on the still semifluid upper layer 12 of the same (or strictly compatible) polymer, while the upper layer is being uninterruptly poured at 34 and doctored at 36 and therefore formed at the desired uniform thickness.

The portions 12 and 12*c* of the semifluid polymer will promptly unite and intermix for jointly providing an unitary structure of exceptional resistance to the action of the traffic. By making use of known elements E*l* of relatively large dimensions (such as from 2 to 7 mm at their minor essentially vertical axis and from 5 to 10 mm at their essentially horizontal diameter, provided that the former dimension is noticeably smaller than the latter dimension), protuberances R′ (FIG. 6) possessing an exceptional retro-collimating ability and a more than necessary ability to ensure non-skid property to the road marking surface S*s* are provided. In such embodiment, the steps described in one or more of FIGS. 2 to 4 can be performed also, if a better non-skid property is desired at the intervals between the protuberances R′ of FIG. 6. The step of FIG. 10 provides the additional advantages that the protuberances having one or more retro-collimating elements E*l* at their top portions can be arranged anywhere desired on the upper layer 12 without adjustment of the upper layer forming means and devices.

I claim:

1. A method of making a preformed roadway marking strip, comprising the steps of providing a lower layer of base-forming material which is to be subsequently applied over a roadway surface;

applying a hardenable synthetic plastic material over said lower layer to form thereon an upper layer of such synthetic plastic material;

embedding anti-skid particles in said upper layer prior to hardening of said synthetic plastic material;

applying additional quantities of synthetic plastic material onto said upper layer at longitudinally spaced locations of the same and prior to hardening of the material thereof, so that each such additional quantity forms a protuberance on said upper layer; and cascading light-reflective particles over said protuberances prior to hardening of the synthetic plastic material thereof, so that upon subsequent hardening said light-reflective particles adhere to said protuberances.

2. A method as defined in claim 1; and further comprising the step of embedding light-reflective particles in said upper layer together with said anti-skid particles.

* * * * *